United States Patent [19]

Kohyama

[11] 4,295,443

[45] Oct. 20, 1981

[54] DEVELOPING APPARATUS FOR ELECTROSTATIC COPYING MACHINE

[75] Inventor: Mitsuaki Kohyama, Higashikurume, Japan

[73] Assignee: Toshiba Corporation, Kawasaki, Japan

[21] Appl. No.: 133,664

[22] Filed: Mar. 25, 1980

[30] Foreign Application Priority Data

Apr. 18, 1979 [JP] Japan ..... 54-47524

[51] Int. Cl.[3] ..... G03G 15/09

[52] U.S. Cl. ..... 118/657

[58] Field of Search ..... 427/657

[56] References Cited

U.S. PATENT DOCUMENTS 4,187,330 2/1980 Harada ..... 118/657

4,218,691 8/1980 Fujii ..... 118/657

*Primary Examiner*—Bernard D. Pianalto

*Attorney, Agent, or Firm*—Schuyler, Banner, Birch, McKie & Beckett

[57] ABSTRACT

A developing apparatus for developing an electrostatic image on an electrostatic image bearing member comprises a single component developer, a stationary developing roller adjacent the electrostatic image bearing member. The developing roller comprises an electrically conductive sleeve having a plurality of spaced apart channels on the surface of the conductive sleeve and an electrically conductive segment in each of the channels. The electrically conductive segments are insulated from the conductive sleeve by an insulator in each of the channels. A voltage source is connected between the conductive sleeve and the conductive segments for applying voltage to the developer to thereby charge the developer. The developer is then moved across the developing roller to the electrostatic image bearing member. The developer is evenly charged by the voltage source as it moves across the surface of the developing roller.

9 Claims, 12 Drawing Figures

FIG. 2
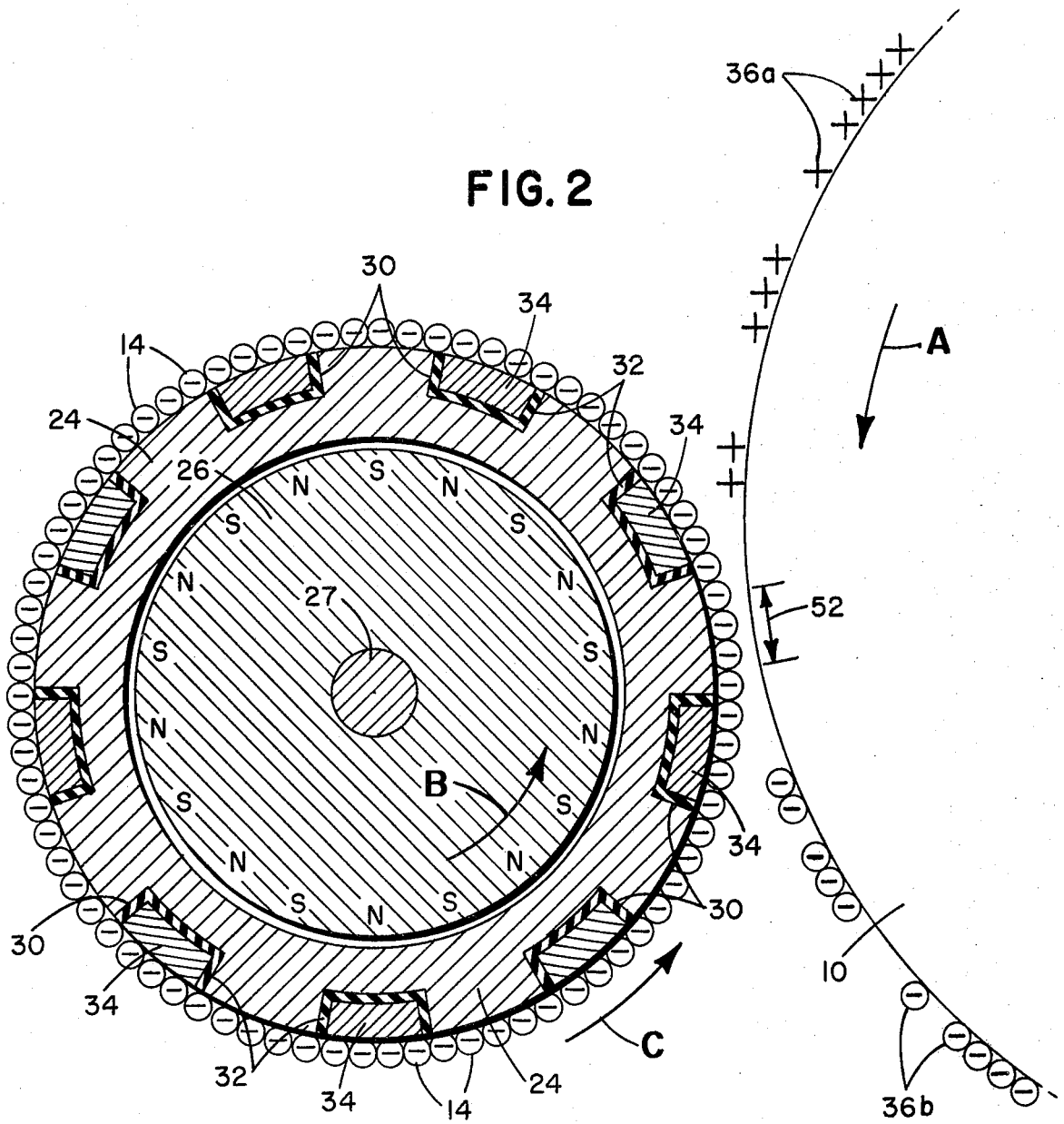
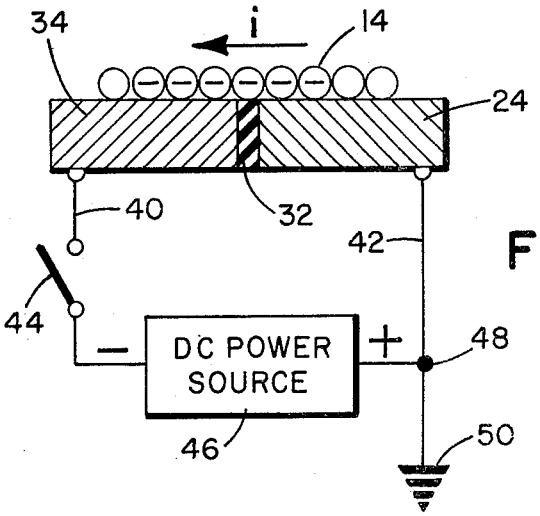
FIG. 3

FIG. 5
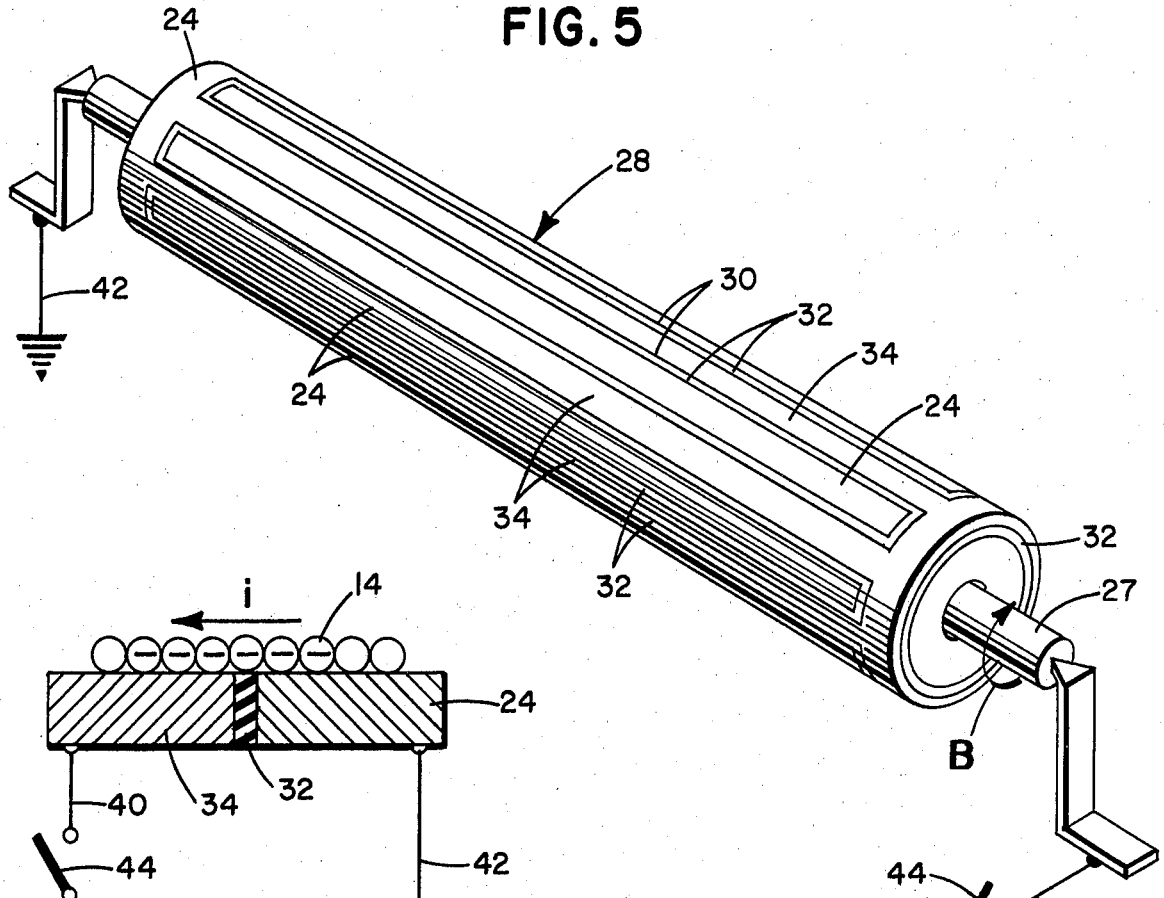
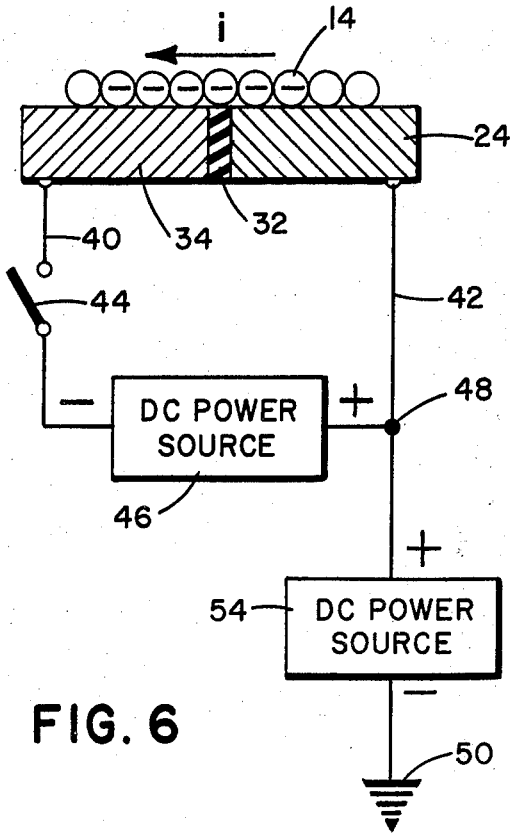
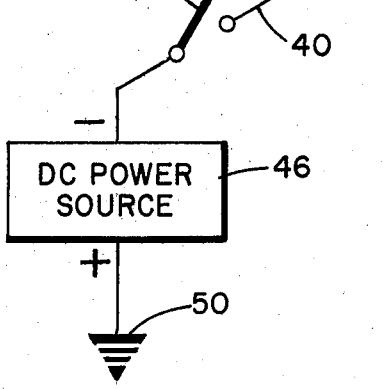
FIG. 6

DEVELOPING APPARATUS FOR ELECTROSTATIC COPYING MACHINE

BACKGROUND OF THE INVENTION

This invention relates to a developing apparatus for an electrostatic copying machine, and more particularly to a dry or powder type developing apparatus employing a single component developer.

In general, in electrostatic copying machines, a photosensitive member is charged. The photosensitive member then is exposed to a light image corresponding to the original subject matter to form a latent electrostatic image on the photosensitive member. In accordance with the electric potential of the latent electrostatic image, the developing apparatus causes an electrically charged developer to adhere to the latent electrostatic image on the photosensitive member. The developed image is then transferred to and fixed on paper. In this manner, copies are obtained by a typical electrostatic copying machine.

As to the developing apparatus in such electrostatic copying machines, there are two types. The first type uses a double component developer comprising a toner and a carrier, and the other type uses a single component developer comprising only a toner, that is, a developer without a carrier. In the first type of developing apparatus, it is necessary to incorporate a toner concentration controlling device for keeping the mix ratio of the toner and the carrier constant. Thus, this type of developing apparatus has several shortcomings, such as a complicated mechanism, large size and expensive to manufacture.

The present invention relates in particular to the other type of developing apparatus employing a single component developer. Single component developers include either toner powders comprising resins and pigments or magnetic toners comprising a mixture of resins and magnetic iron powders or resins containing magnetic powders.

A developing apparatus using a single component developer is shown in U.S. Pat. No. 4,100,884 (Mochizuki et al). The developing apparatus disclosed in FIG. 2 of this patent comprises a movable rubber roller, a plurality of magnets disposed within the hollow space of the roller, a hopper disposed above the roller which contains a quantity of magnetic toner, a levelling member disposed next to the hopper close to or in gentle contact with the roller surface and a triboelectric charger positioned in pressure contact with the movable rubber roller. With the rotation of the rubber roller, magnetic toner particles are carried out of the hopper to form a toner layer on the roller surface. The toner layer is levelled by the levelling member and then scrubbed by the triboelectric charger to charge the toner layer to a predetermined polarity. The charged particles of the toner layer are then conveyed into contact with a latent electrostatic image on an image bearing or photosensitive member.

The above apparatus has several shortcomings. The toner particles often are dropped or scattered at the triboelectric charger because a gap is formed between the rubber roller and the triboelectric charger. The gap occurs because the triboelectric charger, which is brought into contact with the rubber roller for sufficient triboelectric charging of the toner, extends beyond the contact point with the rubber roller. As a result, many stray toner particles adhere to the latent electrostatic image on the image bearing member. This shortcoming can be overcome by increasing the contact pressure of the triboelectric charger against the rubber roller; however, the toner particles coagulate or adhere to the surface of the rubber roller due to the increased contact pressure of the triboelectric charger. As a result, it is impossible to selectively separate the toner particles from the surface of the rubber roller by the electric attraction of the latent electrostatic image formed on the image bearing or photosensitive member. Accordingly, good images cannot be obtained by this developing apparatus.

Finally, in order to uniformly charge the toner layer, the triboelectric charger must make uniform contact along the longitudinal axis of the rubber roller. It is very difficult with the above described apparatus to achieve uniform contact between the triboelectric charger and the rubber roller.

SUMMARY OF THE INVENTION

It is an object of the present invention to provide an improved developing apparatus for electrostatic copying machines which obviates the above shortcomings, particularly the shortcoming of dropping or scattering toner particles at the contact point of the triboelectric charger and the rubber roller.

It is a further object of the present invention to provide a developing apparatus which prevents the coagulation or adherence of toner particles to the surface of the rubber roller.

Finally, it is an object of the present invention to provide a developing apparatus which uniformly charges the toner particles to a sufficient charge.

The present invention is directed to a single component developer type developing apparatus for developing a latent electrostatic image on a photosensitive drum or other image bearing member. A stationary developing roller is positioned adjacent the photosensitive drum. In a first embodiment, the roller is formed of an electrically conductive sleeve with a plurality of conductive segments positioned in channels on the surface of the sleeve. The segments are insulated from the sleeve and a voltage is applied therebetween to charge the developer as it is moved across the sleeve by a rotating magnet positioned within the sleeve. In a second embodiment, the developing roller is formed of an insulative sleeve with two groups of electrically conductive segments alternately positioned in channels on the surface of the insulative sleeve. A voltage source is then connected between the two groups of segments to charge the developer as it moves across the surface of the developing roller.

BRIEF DESCRIPTION OF THE DRAWINGS

FIG. 2 is a sectional view of the developing apparatus of FIG. 1.

FIG. 3 is an enlarged sectional view showing the details of the toner charging mechanism for the embodiment of FIG. 2.

FIG. 5 is a perspective view of the developing roller of FIG. 2.

FIGS. 6–8 are enlarged sectional views showing the details of three different modifications of the toner charging mechanism of FIG. 2.

DETAILED DESCRIPTION OF THE PREFERRED EMBODIMENT

Figure 1:
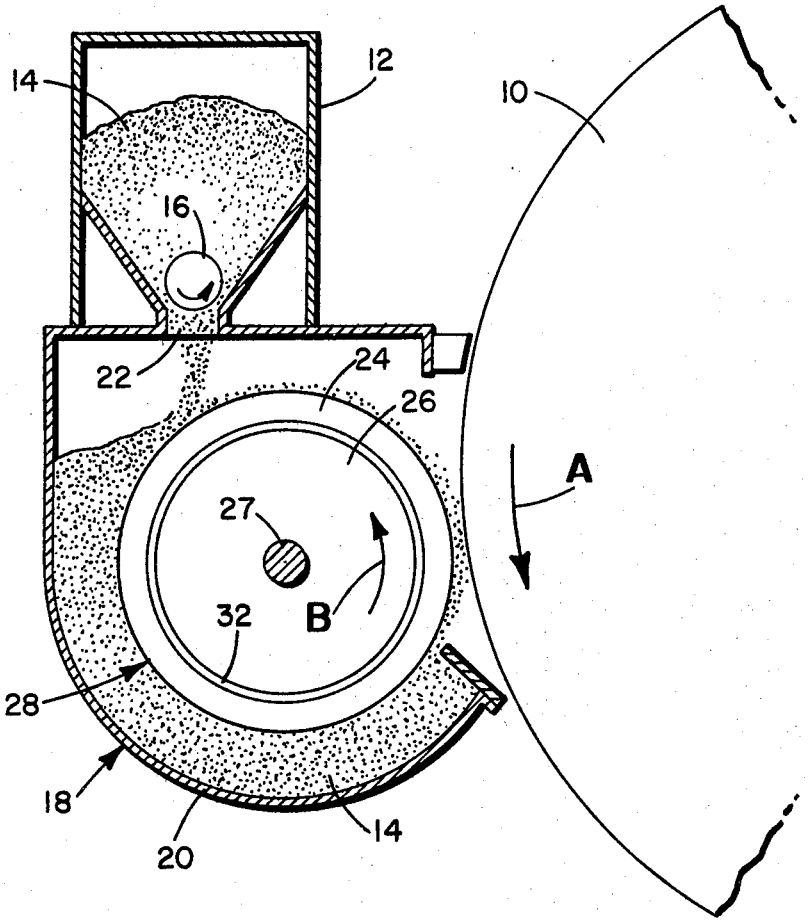
FIG. 1 is a side view of the developing apparatus for an electrostatic copying machine according to the present invention.

Referring now to FIGS. 1–5, an explanation will be given regarding a preferred embodiment of the invention. As shown in FIGS. 1–2, the electrostatic copying machine of the present invention comprises an electrostatic image bearing member such as photosensitive drum 10, a toner hopper 12 and a developing apparatus 18 which includes a developing roller 28. The photosensitive drum 10 is linked to an appropriate drive means (not shown) to rotate in the direction indicated by arrow A.

The developing apparatus 18 includes a housing 20 which contains a single component developer 14 and developing roller 28. The developer 14 is supplied to the housing 20 from a hopper 12 located above the housing 20. The lower portion of hopper 12 contains an opening 22 which passes the developer from the hopper 12 to the housing 20 upon rotation of a supply roller 16. When the roller 16 rotates, the developer 14 in hopper 12 is supplied to the housing 20 through small openings between the roller 16 and the edges of opening 22.

The single component developer does not include carrier particles but rather comprises resins containing magnetic powders. The developer 14 has a volume resistivity of not less than $10^{11}\Omega$ cm and the particle size is on the order of 10 microns.

As shown in FIG. 2, the developer 14 is charged to negative polarity and adheres to developing roller 28 until it is electrostatically attracted to the drum 10. The positive latent electrostatic image at position **36*a* of the drum 10 is changed or developed to a visible powder image at position 36*b***.

Figure 4:
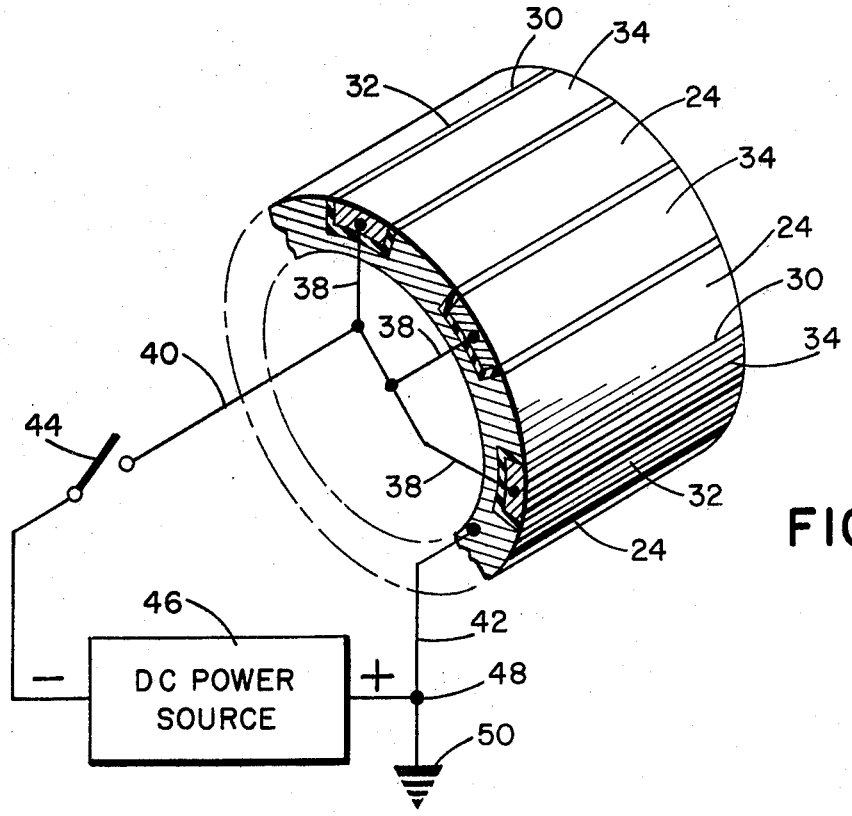
FIG. 4 is a perspective view of the developing roller and voltage source of the developing apparatus of FIG. 2.

The developer roller 28 further includes a cylindrical member or sleeve 24 which is made of an electrically conductive non-magnetic material such as aluminum or brass. The sleeve 24 is stationary and has a plurality of spaced channels 30 on the surface of the sleeve 24. The channels 30 are provided along the axial direction of the sleeve 24 as best illustrated in FIG. 4. Insulators 32 are positioned inside the channels 30 against the walls and bottom surface of the channels 30. Electrically conductive segments 34 are then embedded in the channels 30, electrically separated from the conductive sleeve 24 by the insulators 32. The surface of each segment 34 is exposed on the outer surface of the sleeve 24.

A magnet 26 having alternately magnetized North (N) and South (S) magnetic poles on its surface is contained within the conductive sleeve 24. The magnet is linked to appropriate drive means (not shown) to rotate in the direction indicated by arrow B. The magnet 26 is used to transport the developer on the surface of the conductive sleeve 24 in a well known manner as described in Japanese Patent Publication No. 37-24798 (Takamatsu).

As shown in FIGS. 4–5, the conductive segments 34 are electrically insulated from the sleeve 24 by insulators 32. The conductive segments 34 are electrically connected by wires 38 to a common lead 40 which is electrically connected to the negative terminal of a DC power source 46 (e.g., 600 volts) through a switching element 44 which is normally closed during operation of the developing apparatus. Sleeve 24 is electrically connected by wire 42 to the positive terminal of the DC power source 46 through terminal 48 which is electrically connected to ground terminal 50. Since the conductive sleeve 24 is stationary, a slip ring assembly is not necessary for connecting the common lead 40 and wire 42.

Turning again to FIG. 2, the conductive segments 34 are not positioned adjacent the developing station 52 of the photosensitive drum 10. This is because the latent electrostatic image **36*a* formed on the drum 10 would be cancelled by the electrical interference of the conductive segments 34. Namely, if one of the conductive segments 34, which is connected to a power source of −600 volts, was located adjacent the surface of drum 10, the density of the charge of the image at position 36*a*** would be decreased.

Although the operation of the developing apparatus is apparent from the above description, a brief explanation will be given. When the magnet 26 rotates in the direction B, as shown in FIG. 2, the developer 14 adheres to the peripheral surface of the conductive sleeve 24 as a result of the magnetic field of the magnet 26. The developer 14 is transported upon rotation of magnet 26 on the peripheral surface of sleeve 24 in the C direction. At this time, about −600 volts is applied between the conductive segments 34 and the conductive sleeve 24 and, as shown in FIG. 3, a current flows through the developer 14 between each segment 34 and the sleeve 24. Since the segments 34 and sleeve 24 are insulated from each other by insulator 32, when the DC power source 46 is applied between them, an electric current flows through the developer 14 on the surface of sleeve 24. When the current i flows, developer 14 is negatively charged to a desired polarity. Each segment 34 is positioned at a fixed interval along the transportation direction C of the developer 14 so that the developer 14 is charged repeatedly. During the transportation of developer 14, the toner particles of the developer 14 are rotating so that these particles are gradually and evenly charged. The proper value of the DC power source 46 can be determined experimentally by considering the electrical resistance of the developer 14 and the distance between each segment 34. The developer 14 is evenly charged to a desired polarity (negative in this case) and transported to the developing station 52 by the magnetic field of the rotating magnet 26. The developer 14 adheres to the latent electrostatic image **36*a* formed on the photosensitive drum 10, and a visible powder image at position 36*b*** is formed.

Figure 7:
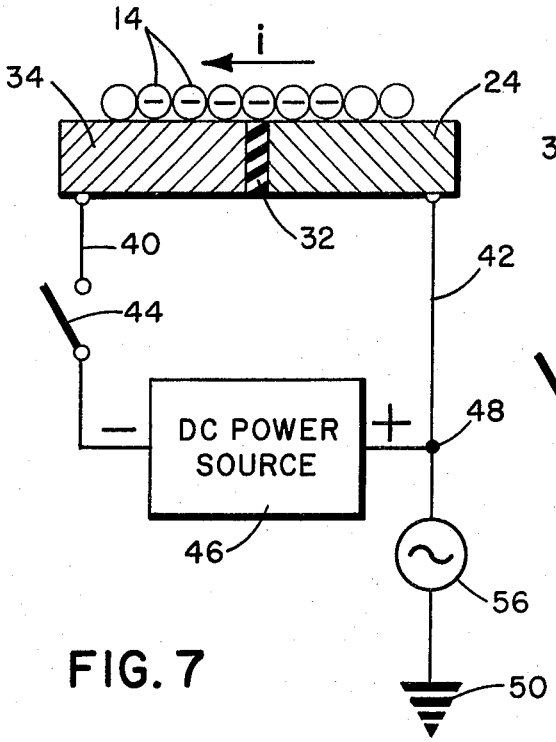
Figure 8:
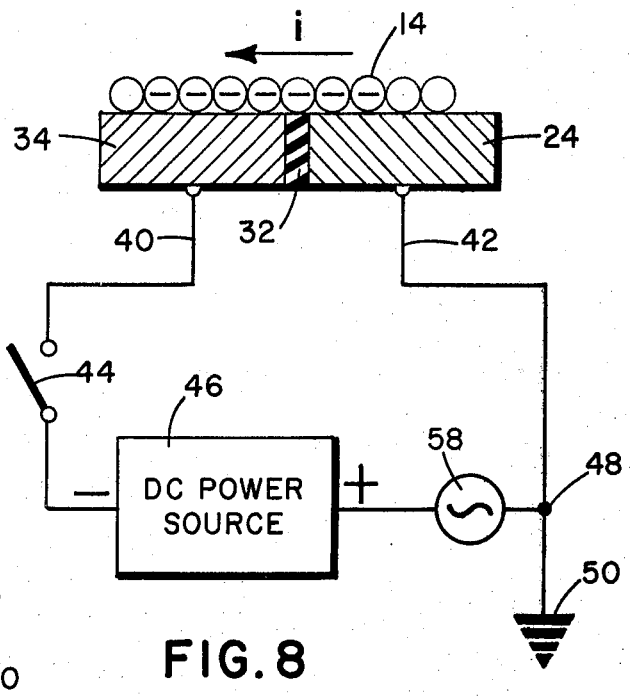

FIGS. 6–8 show modifications of the power supply for the developing apparatus of FIGS. 2–5. In FIG. 6, the positive terminal of a DC power source 54 (e.g., 100–300 volts of biasing voltage) is connected to the connection terminal 48 and the negative terminal is connected to ground terminal 50. During the development of the latent electrostatic image on the drum 10, the biasing voltage of power source 54 is applied to sleeve 24. As a result, the visible powder image produced on the drum 10 at position 36*b* has a very high contrast characteristic and a minimum amount of spurious deposit in the background areas. A developing apparatus using a DC power source for providing a biasing voltage such as described above is shown in U.S. Pat. No. 3,117,884 (H. G. Greig). In FIG. 7, an AC power source 56 is connected between the connection terminal 48 and the ground terminal 50. During the transportation of charged developer 14 on the sleeve 24, the developer 14 is vibrated by the application of the AC power source 56. Therefore, the developer 14 does not coagulate or adhere to the surface of sleeve 24. But, if the frequency of the AC power source 56 is less than 100 Hz, the visible powder image at position 36*b* on the drum 10 will have a striped pattern; it is desirable that the AC power source have a frequency of more than 100 Hz.

In FIG. 8, an AC power source 58 is connected between the positive terminal of the DC power source 46 and the connection terminal 48. During the transportation of charged developer 14 on the sleeve 24, the developer 14 is vibrated as described above and the developer 14 does not coagulate or adhere to the surface of sleeve 24. In this embodiment, as the developing station 52 is not influenced by the AC voltage, the visible powder image at position 36*b* of the drum 10 will not have a striped pattern.

Figure 10:
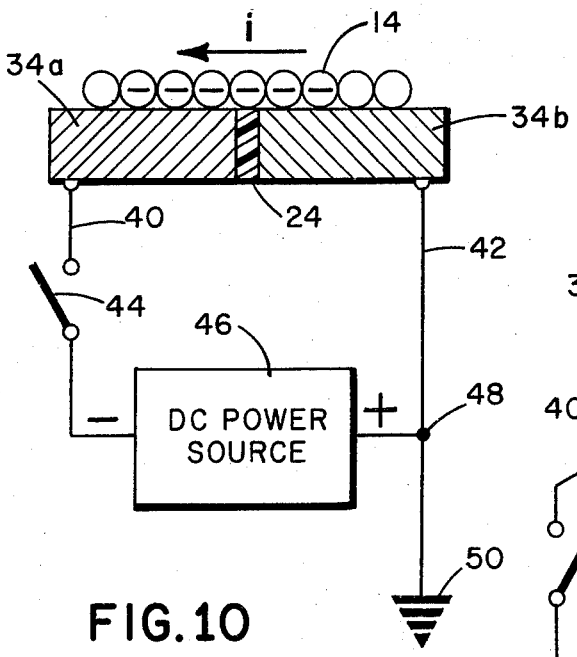
FIG. 10 is an enlarged sectional view showing the details of a toner charging mechanism for the embodiment of FIG. 9.
Figure 11:
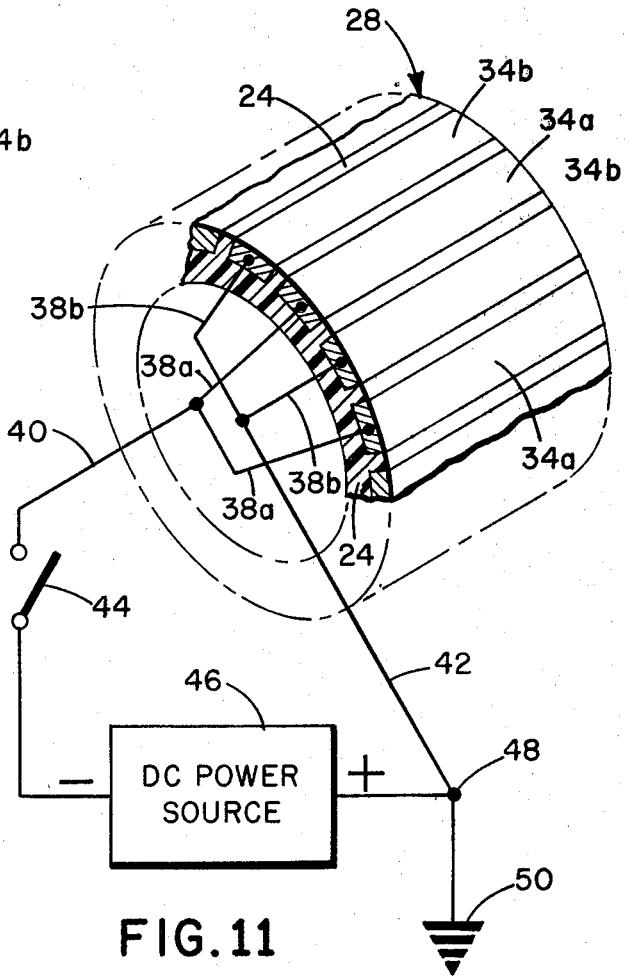
FIG. 11 is a perspective view of the developing roller and voltage source of the developing apparatus of FIG. 9.
Figure 9:
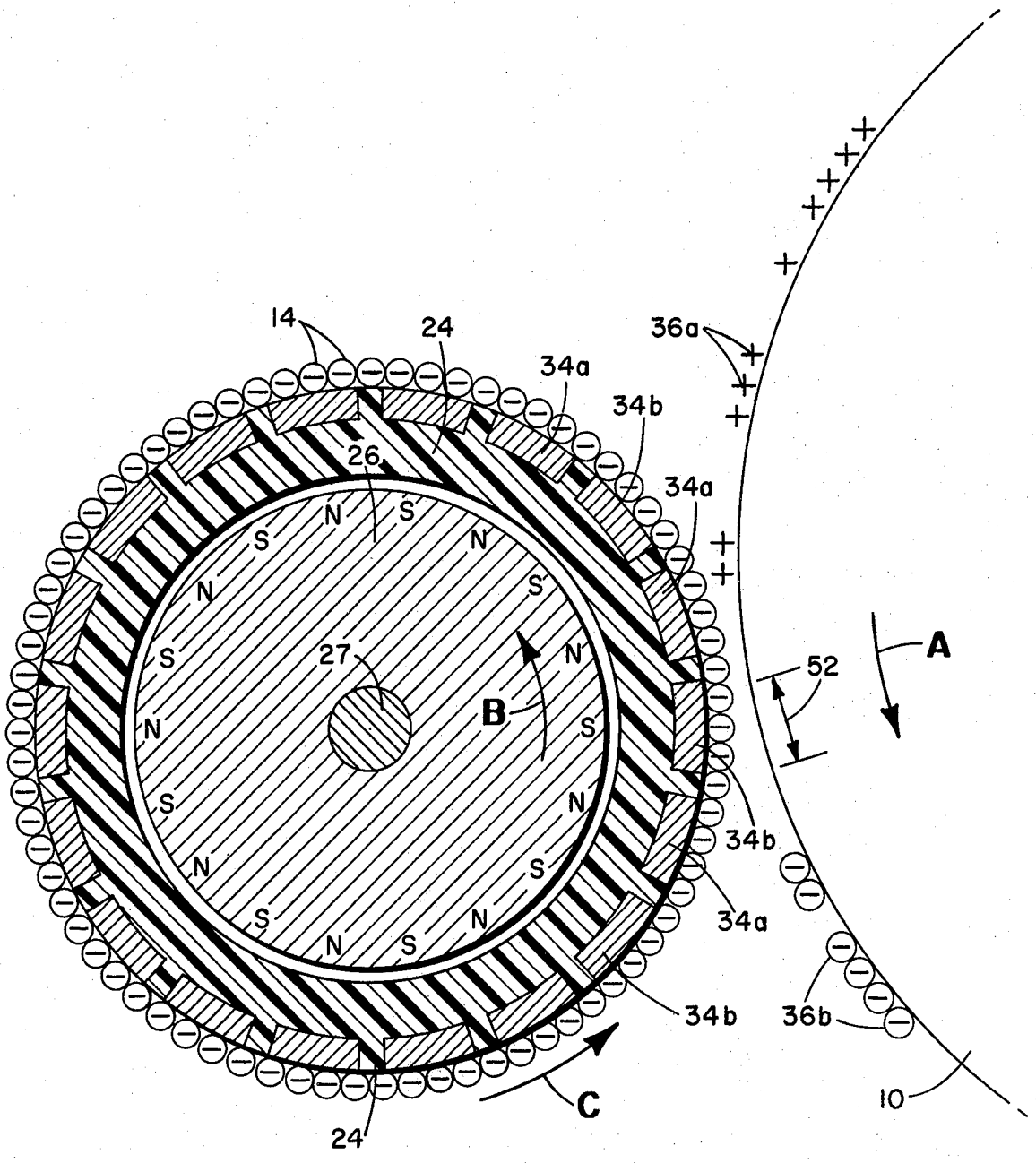
FIG. 9 is a sectional view of a second embodiment of the developing apparatus according to the present invention.
Figure 12:
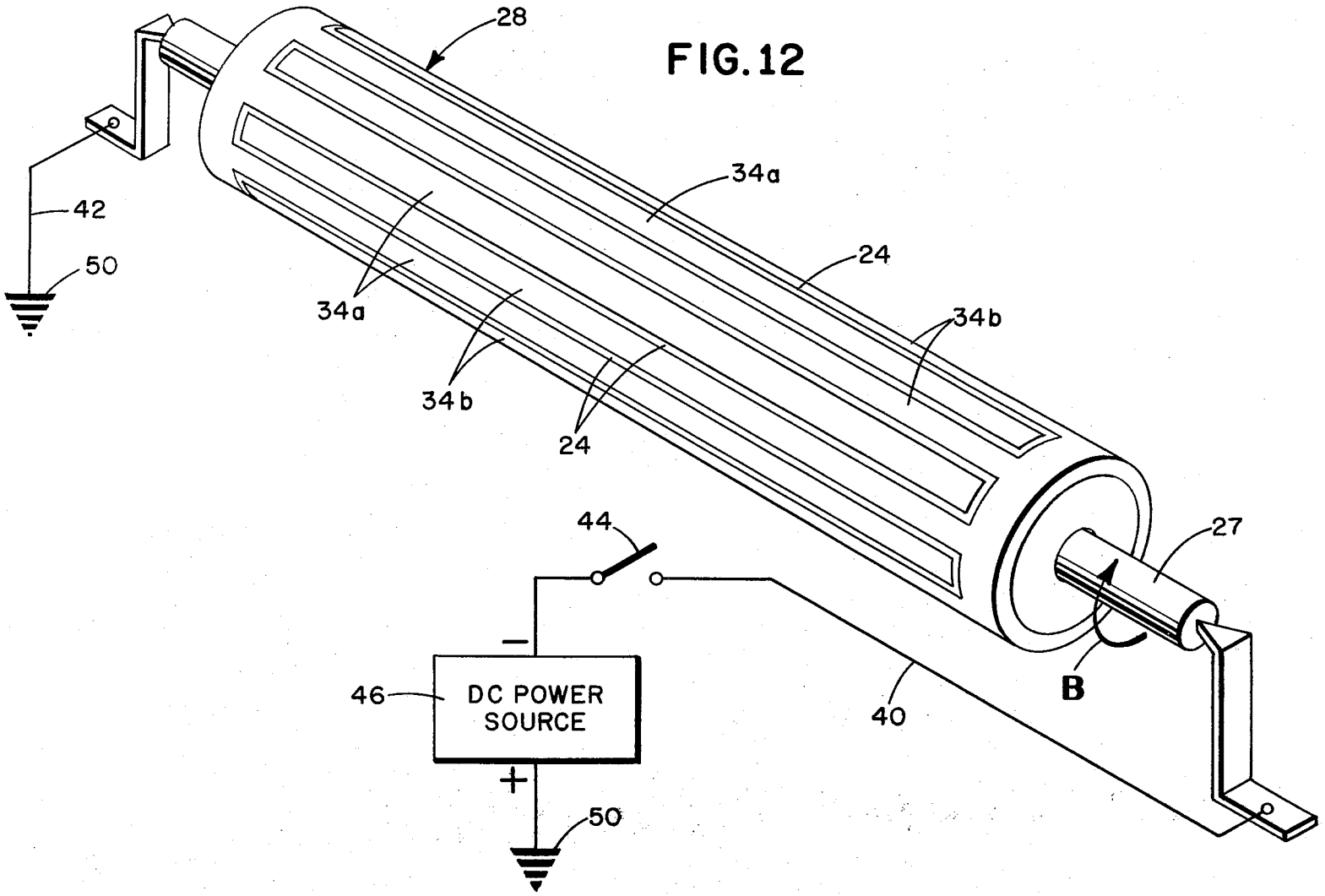
FIG. 12 is a perspective view of the developing roller of FIG. 9.

A second embodiment of the developing apparatus of the present invention is shown in FIGS. 9–11. The sleeve 24 is made of an insulated material, such as plastic, and it is non-magnetic. The conductive segments 34*a* and 34*b* are spaced from each other on the surface of insulated sleeve 24. Segments 34*a* and 34*b* are alternatively positioned and connected to a DC power source 46 in the manner illustrated in FIGS. 10–12. None of the segments 34*a* is positioned to face the drum 10; however, a segment 34*b*, which is electrically connected to ground terminal 50 as shown in FIG. 10, faces the drum 10. The operation of the developing apparatus of this second embodiment is similar to the operation of the first embodiment as described above.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention.

I claim:

1. A developer apparatus for developing an electrostatic image on an electrostatic image bearing member, comprising:

a single component developer;

a stationary developing roller adjacent said electrostatic image bearing member, said developing roller comprising an electrically conductive sleeve having a plurality of spaced apart channels on the surface of said conductive sleeve, an electrically conductive segment in each of said channels and an insulator in each of said channels between said conductive sleeve and said electrically conductive segment;

voltage means connected to said conductive sleeve and said conductive segments for applying voltage between said conductive sleeve and said conductive segments to charge the developer; and developer moving means for moving the developer across said developing roller to said electrostatic image bearing member.

2. The developing apparatus of claim 1 further comprising bias voltage means for applying a DC voltage to said sleeve.

3. The developing apparatus of claim 1 further comprising bias voltage means for applying an AC voltage to said sleeve.

4. The developing apparatus of claim 1 further comprising bias voltage means for applying an AC voltage to said conductive segments.

5. The developing apparatus of claim 1 wherein said sleeve is electrically connected to a ground and faces said image bearing member.

6. A developing apparatus for developing an electrostatic image on an electrostatic image bearing member, comprising:

a single component developer;

a stationary developing roller adjacent said electrostatic image bearing member, said developing roller comprising non-magnetic sleeve having a plurality of spaced apart channels on the surface of said sleeve and an electrically conductive segment in each of said channels;

voltage means having a first terminal connected to a first group of said conductive segments and a second terminal connected to a second group of said conductive segments for applying a voltage between said first and second groups of conductive segments to charge the developer; and developer moving means for moving the developer across said developing roller to said electrostatic image bearing member.

7. The developer apparatus of claim 6 wherein at least one segment of a first group of said conductive segments is electrically connected to ground and faces said image bearing member.

8. The developing apparatus of claims 1 or 6 wherein said voltage means applies a DC voltage having a polarity opposite to the polarity of the electrostatic image formed on said electrostatic image bearing member.

9. The developing apparatus of claims 1 or 6 wherein said single component developer is a single component magnetic toner and said developer moving means comprises a cylindrical magnetic roller having a plurality of magnetic poles, said magnetic roller being rotatable within said sleeve.

* * * * *